US008087752B2

(12) United States Patent
Matsumoto et al.

(10) Patent No.: US 8,087,752 B2
(45) Date of Patent: Jan. 3, 2012

(54) APPARATUS FOR PRINTHEAD MOUNTING

(75) Inventors: Nobuo Matsumoto, Cupertino, CA (US); Tadashi Kyoso, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 353 days.

(21) Appl. No.: 12/363,535

(22) Filed: Jan. 30, 2009

(65) Prior Publication Data

US 2010/0194822 A1 Aug. 5, 2010

(51) Int. Cl.
*B41J 2/14* (2006.01)

(52) U.S. Cl. ..... 347/49

(58) Field of Classification Search ..... 347/40–42, 347/49

See application file for complete search history.

(56) References Cited

U.S. PATENT DOCUMENTS

| | | | | |
|---|---|---|---|---|
| 4,851,371 | A | 7/1989 | Fisher et al. | |
| 4,985,710 | A | 1/1991 | Drake et al. | |
| 5,098,503 | A | 3/1992 | Drake | |
| 5,850,240 | A | 12/1998 | Kubatzki et al. | |
| 6,068,367 | A * | 5/2000 | Fabbri | 347/49 |
| 6,457,810 | B1 | 10/2002 | King et al. | |
| 7,108,353 | B2 | 9/2006 | Silverbrook et al. | |
| 7,284,822 | B2 * | 10/2007 | Silverbrook et al. | 347/40 |
| 7,322,666 | B2 | 1/2008 | Walmsley et al. | |
| 7,401,899 | B2 | 7/2008 | Nellen | |
| D582,975 | S | 12/2008 | Aznoe et al. | |
| 7,465,033 | B2 * | 12/2008 | Hibbard et al. | 347/59 |
| 7,467,854 | B2 | 12/2008 | Silverbrook et al. | |
| 2008/0151000 | A1 | 6/2008 | Von Essen et al. | |
| 2009/0014413 | A1 | 1/2009 | Nystrom et al. | |

* cited by examiner

*Primary Examiner* — An Do
(74) *Attorney, Agent, or Firm* — Fish & Richardson P.C.

(57) ABSTRACT

A printhead assembly including a printhead module and a mounting structure is described. The printhead module is mounted on a receiving surface of the mounting structure and includes a first edge and a second edge opposite the first edge. The first and second edges extend beyond edges of the receiving surface by a first distance in a first direction and are positioned between featured edges of the mounting structure in a second direction that is substantially perpendicular to the first direction. Each featured edge includes a first feature protruding from the featured edge by a second distance in the first direction, where the second distance is greater than the first distance. The first features extend beyond the first and second edges of the printhead module. Each featured edge includes a recessed second feature configured to receive a first feature of a neighboring mounting structure.

11 Claims, 7 Drawing Sheets

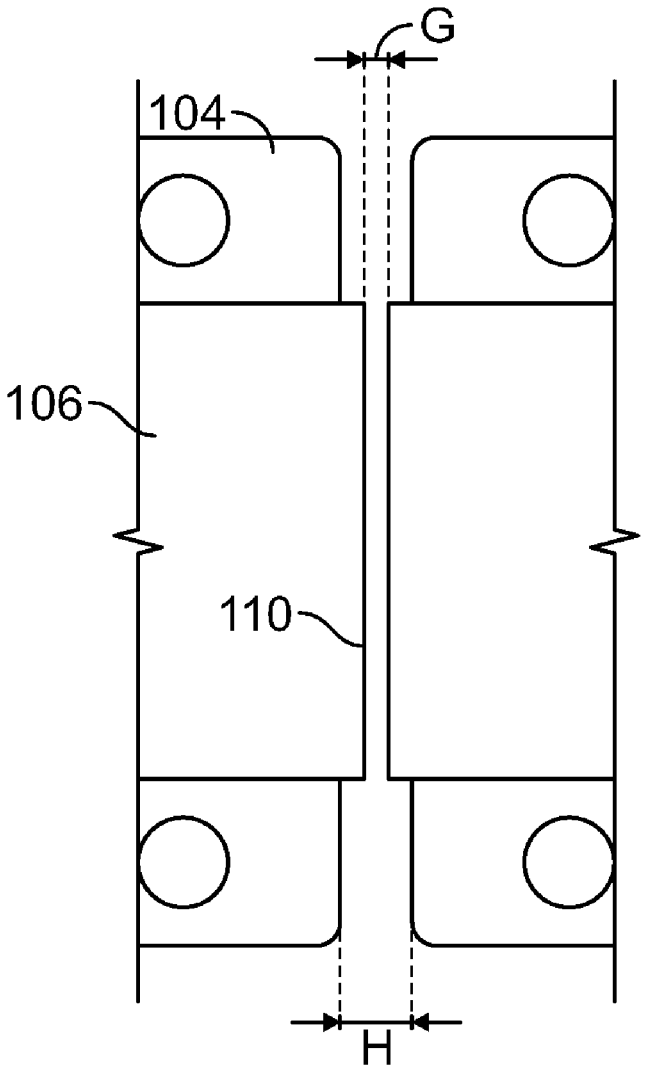
FIG. 2
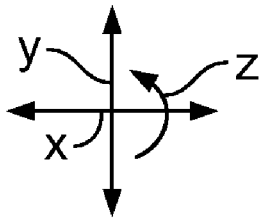

APPARATUS FOR PRINTHEAD MOUNTING

TECHNICAL FIELD

The following description relates to a fluid ejection system for printing.

BACKGROUND

A fluid ejection system, for example, an ink jet printer, typically includes an ink path from an ink supply to a printhead module that includes nozzles from which ink drops are ejected. Ink is just one example of a fluid that can be ejected from a jet printer. Ink drop ejection can be controlled by pressurizing ink in the ink path with an actuator, for example, a piezoelectric deflector, a thermal bubble jet generator, or an electrostatically deflected element. A typical printhead module has a line or an array of nozzles with a corresponding array of ink paths and associated actuators, and drop ejection from each nozzle can be independently controlled. In a so-called "drop-on-demand" printhead module, each actuator is fired to selectively eject a drop at a specific location on a medium. The printhead module and the medium can be moving relative one another during a printing operation.

In one example, a printhead module can include a silicon printhead module and a piezoelectric actuator. The printhead module can be made of silicon etched to define pumping chambers. Nozzles can be defined by a separate substrate (i.e., a nozzle layer) that is attached to the printhead module. The piezoelectric actuator can have a layer of piezoelectric material that changes geometry, or flexes, in response to an applied voltage. Flexing of the piezoelectric layer causes a membrane to flex, where the membrane forms a wall of the pumping chamber. Flexing the membrane thereby pressurizes ink in a pumping chamber located along the ink path and ejects an ink drop from a nozzle at a nozzle velocity. The piezoelectric actuator is bonded to the membrane.

SUMMARY

This invention relates to printing from a fluid ejection system. In general, in one aspect, the invention features a printhead assembly including a printhead module and a mounting structure. The printhead module is mounted on a receiving surface of the mounting structure and includes a first edge and a second edge opposite the first edge where the first and second edges extend beyond edges of the receiving surface by a first distance in a first direction. The first and second edges are positioned between featured edges of the mounting structure in a second direction that is substantially perpendicular to the first direction. The mounting structure includes the receiving surface for mounting the printhead module and the featured edges positioned on either side of the mounting surface in the second direction. Each featured edge includes a first feature protruding from the featured edge by a second distance in the first direction, where the second distance is greater than the first distance, such that the first features extend beyond the first and second edges of the printhead module. Each featured edge further includes a second feature that is recessed from the featured edge and configured to receive a first feature of a neighboring mounting structure.

Implementations of the printhead assembly can include one or more of the following features. Each first feature can be configured as a nub and each second feature can be configured as a dimple. In some implementations, each nub protrudes from a featured edge of the mounting structure along an axis that is substantially perpendicular to the featured edge from which the nub protrudes. Each dimple can have a depth extending along an axis that is substantially perpendicular to a featured edge of the mounting structure from which the dimple is recessed. The first features and the second features can be arranged symmetrically or asymmetrically about a central longitudinal axis of the receiving surface.

The printhead module can have a substantially rectangular shape. In other implementations, the printhead module has a non-rectangular parallelogram shape and the first and second edges extend beyond the edges of the receiving surface at an angle, where the first distance is the greatest distance by which the first and second edges extend beyond the edges of the receiving surface.

The dimensions of the first features and the second features can be such that first features of the mounting structure are received into second features of a second mounting structure when the two mounting structures are positioned adjacent one another, without interfering with the position of the printhead module mounted in the mounting structure relative to a second printhead module mounted in the second mounting structure. In some implementations, the depth of a first feature of the mounting structure is less than a sum of the depth of a second feature of the second mounting structure positioned to receive said first feature, a gap between the printhead module and the second printhead module, the first distance by which the printhead module extends beyond the edge of the mounting structure, and a distance by which the second printhead module extends beyond the edge of the second mounting structure.

The mounting structure can include a central portion including the receiving surface on a face of the central portion, and winged portions. The winged portions can flank two opposing sides of the central portion and extend beyond a width of the central portion, where the featured edges are edges on the winged portions. The winged portions can be configured to attach the mounting structure to a fluid ejection system.

Implementations of the invention can realize one or more of the following advantages. Providing features along the edge of the mounting structure that extend beyond the exposed edges of the printhead module mounted therein can protect the exposed edges from damage. For example, during an assembly process where the printhead module already mounted within the mounting structure, handling of the printhead module/mounting structure assembly can result in stresses being placed on the exposed edges of the printhead module. However, by providing the features along the edge of the mounting structure, e.g., nubs, the features can absorb the stresses rather than the exposed edges of the printhead module, reducing the risk of damage to the printhead module. In an implementation where the first features are positioned asymmetrically about the central longitudinal axis of the receiving surface for the printhead module (i.e., as a mirror image about the central longitudinal axis, see for example FIG. 4C), the mounting structure cannot be inadvertently mounted backwards (i.e., rotated by 180°) onto the frame of a fluid ejection system if being mounted adjacent another mounting structure. That is, when the first features are asymmetrically positioned, they will only mate with second features of an adjacent mounting structure mounted onto the frame when the mounting structure is in one orientation.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 2 shows a partial plan view of two adjacent printhead modules mounted in adjacent mounting structures.

Like reference symbols in the various drawings indicate like elements.

DETAILED DESCRIPTION

Figure 1A:
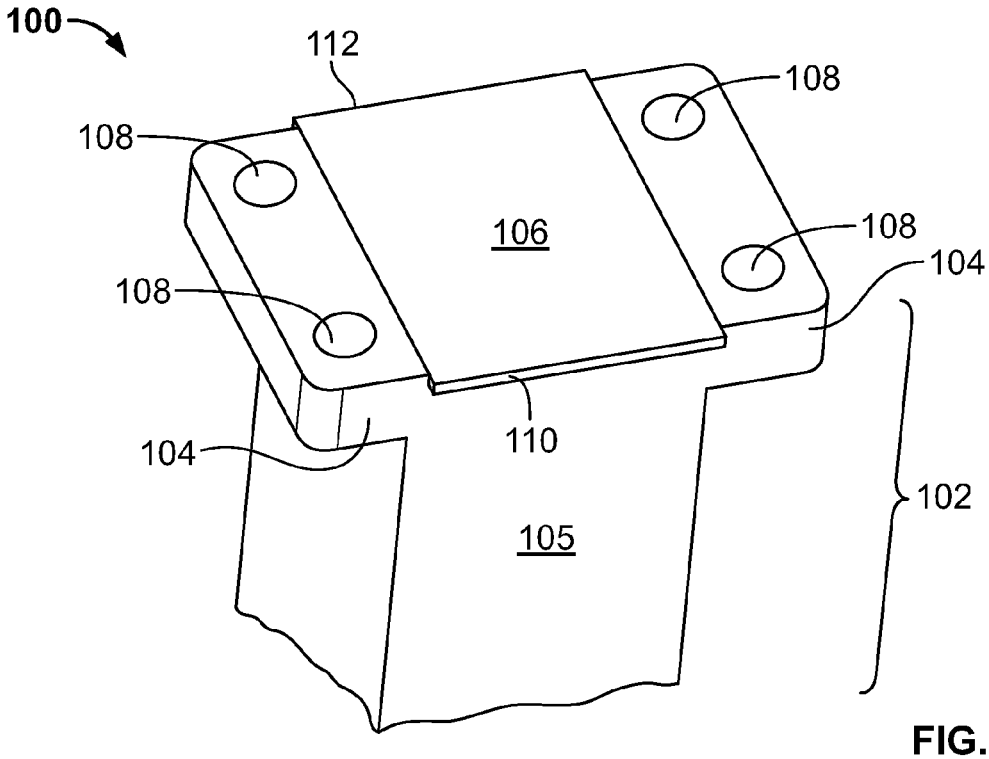
FIG. 1A shows a perspective view of a printhead module mounted in a mounting structure.

FIG. 1A shows a simplified representation of a printhead module 106 mounted in a mounting structure 102. The printhead module is typically formed of silicon and is relatively thin, for example, having a thickness in the range of approximately 0.3 to 2.0 millimeters. The exposed planar face shown in FIG. 1A of the printhead module 106 is the nozzle face and includes an array of nozzles (not shown) from which a printing fluid can be ejected. The printing fluid can be ink, but also can be other liquids, for example, electroluminescent material used in the manufacture of liquid crystal displays or liquid metals used in circuit board fabrication, or biological fluid.

Figure 1B:
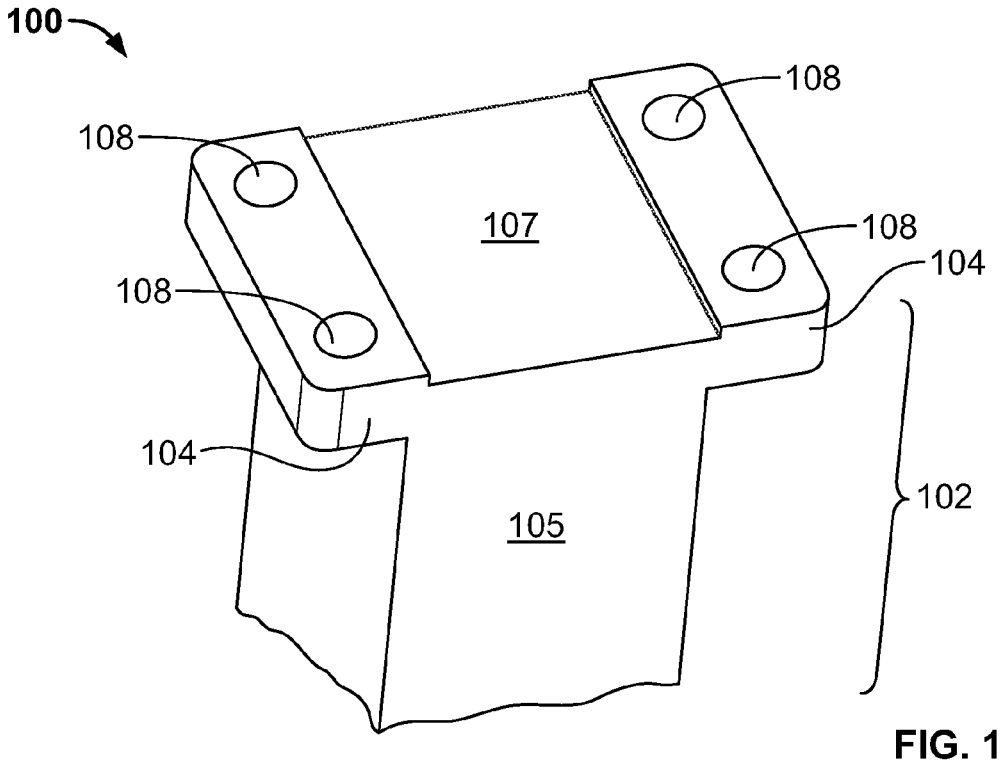
FIG. 1B shows the mounting structure of FIG. 1A.

FIG. 1B shows the mounting structure with the printhead module 106 removed. In this implementation, the mounting structure includes a central portion 105 flanked on two opposing sides by winged portions 104. A receiving surface 107 for the printhead module 106 is included on an end of the central portion 105. Other configurations of mounting structure are possible, and the one shown is but one example.

The printhead module 106 is mounted on the receiving surface 107 in the mounting structure 102 between the two opposing winged portions 104. In the mounting structure configuration shown, the winged portions 104 are configured with apertures 108, such that the wing portions can be attached to a fluid ejection system where the mounting structure is supported by a frame attached to the winged portions 104 by connecting members passing through the apertures. It should be understood that the mounting structure can be attached to the fluid ejection system in other manners, for example, by an adhesive, and including apertures in the wing portions is optional. Typically, two or more printhead modules and mounting structures are mounted to such a frame. The nozzles included in each printhead module are aligned relative to one another when mounting to the frame, so as to provide a larger array of nozzles with consistent spacing between neighboring nozzles. To provide for some manipulation of the printhead module 106 when mounting the mounting structure 102 into a fluid ejection system, the exposed edges 110 and 112 of the printhead module 106 extend past the edges of the winged portions 104.

FIG. 2 shows two printhead modules mounted in adjacent mounting structures and positioned adjacent one another, for example, as they may be positioned when mounted within the frame of a fluid ejection system. Although exaggerated for illustrative purposes, there is typically a gap "G" between the edges of the adjacent printhead modules and a larger gap "H" between the edges of the corresponding mounting structures. The gap "H" allows the relative positions of the printhead modules to be adjusted in one or more directions, for example, in the x direction or y direction, and/or rotationally in the z direction. The relative positions of the printhead modules, and accordingly the nozzles included therein, can thereby be adjusted to provide for precise nozzle alignment as between neighboring printhead modules before attaching the corresponding mounting structures to the frame of the fluid ejection system.

Figure 3A:
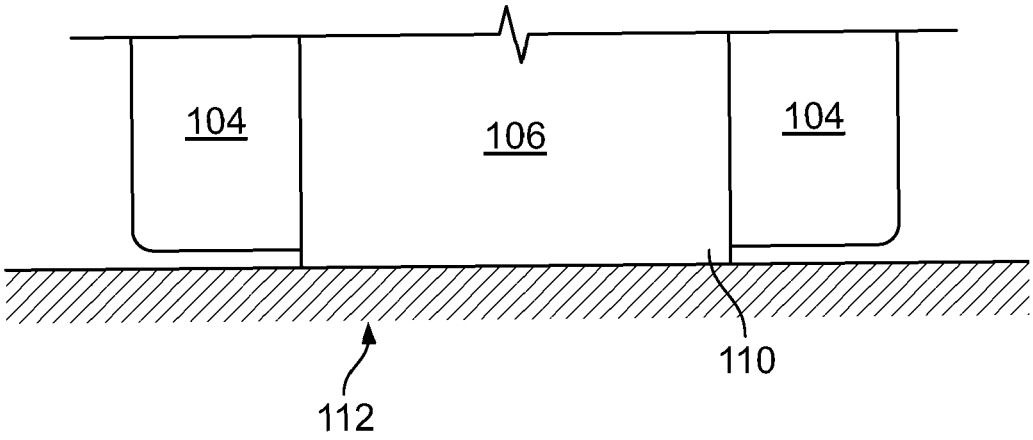
FIG. 3A shows a partial view of the printhead module and mounting structure of FIG. 1 resting on a surface.

A difficulty with the mounting structure 102 shown in FIG. 1B is illustrated in FIG. 3A. Because the edges 110 and 112 of the printhead module 106 extend past the winged portions 104 of the mounting structure, they are vulnerable to damage during assembly of the printhead module into a fluid ejection system. FIG. 3A shows a view of the configuration shown in FIG. 1A resting on end against a surface 112, which could occur during the assembly process. The entire weight (or a substantial portion thereof) of the printhead module/mounting structure assembly can end up on the exposed edge 110 of the printhead module. Because the printhead module 106 is formed from a relatively thin layer of silicon, the exposed edge 110 is prone to damage. The printhead module 106 can be an expensive element in the assembly and if damaged, may be rendered completely unusable. Accordingly, preventing damage to the printhead module 106 and the exposed edges 110 and 112 is important to avoid unnecessary manufacturing expenses and delays.

Figure 3B:
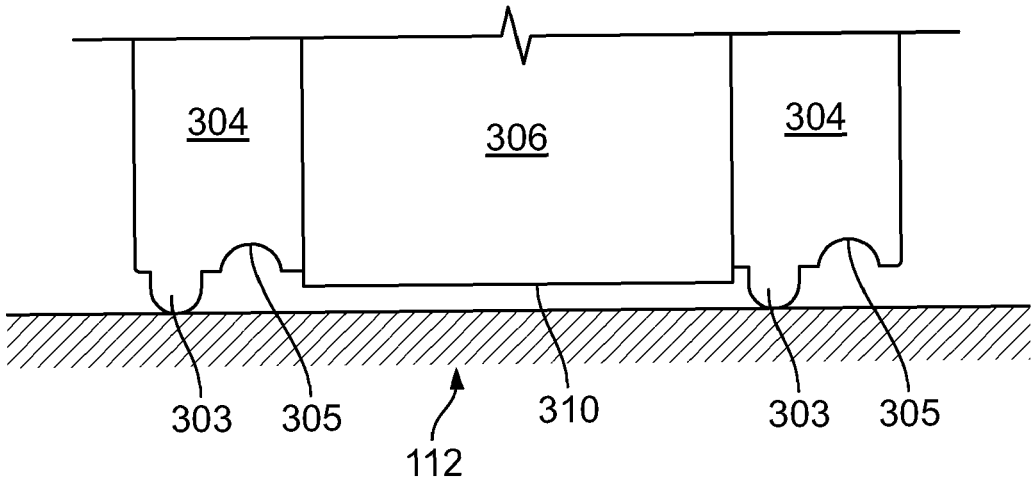
FIG. 3B shows a printhead module mounted in a mounting structure according to the invention described herein.

FIG. 3B shows a partial view of a printhead module 306 mounted within a mounting assembly including winged portions 304. The winged portions 304 each include on their edges adjacent the exposed edges of the printhead module (e.g., edge 310) features that extend beyond the exposed edges of the printhead module. In the implementation shown, the features are nubs 303 that extend past the exposed edge 310 of the printhead module 306. As such, when the printhead module/mounting structure assembly is resting against a surface 112, as shown, the weight of the assembly is on the nubs 303 rather than the exposed edge 310 of the printhead module 306. The edge 310 is less likely to come into contact with other surfaces and less vulnerable to damage. Dimples 305 are also provided along the edges of the winged portions 304 for allow a recess for the nubs 303 to position in when multiple mounting structures are arranged adjacent one another in a fluid ejection system, as is described further below.

Figure 4A:
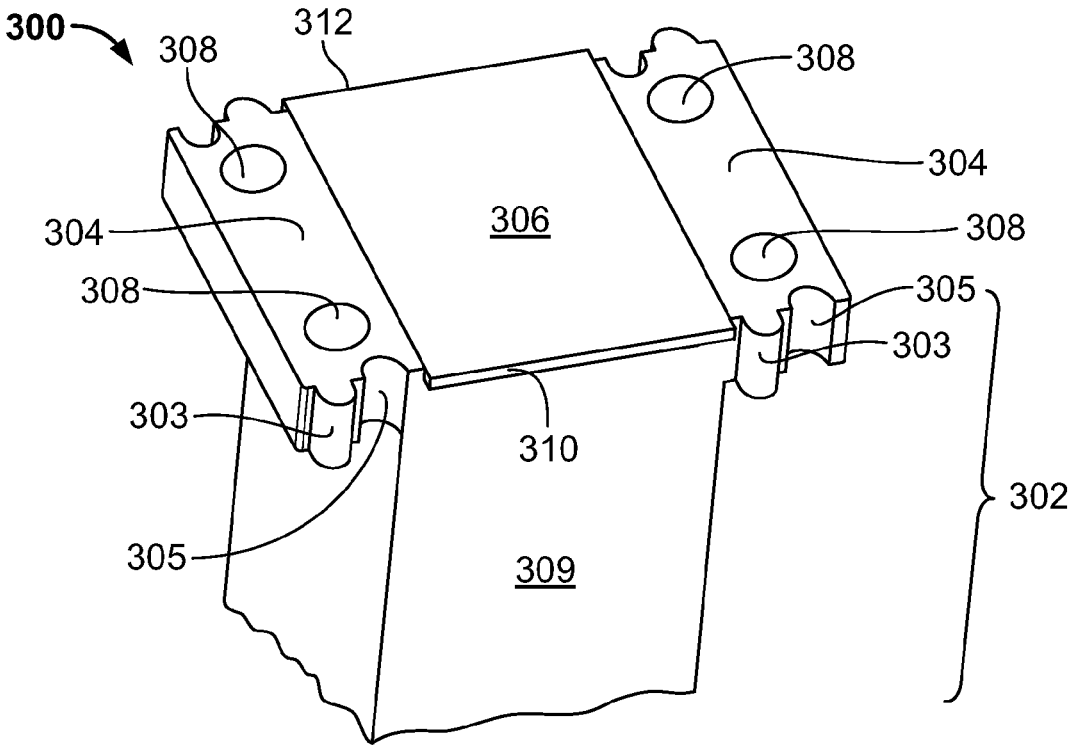
FIG. 4A shows a perspective view of the printhead module mounted in the mounting structure shown in FIG. 3B.
Figure 4B:
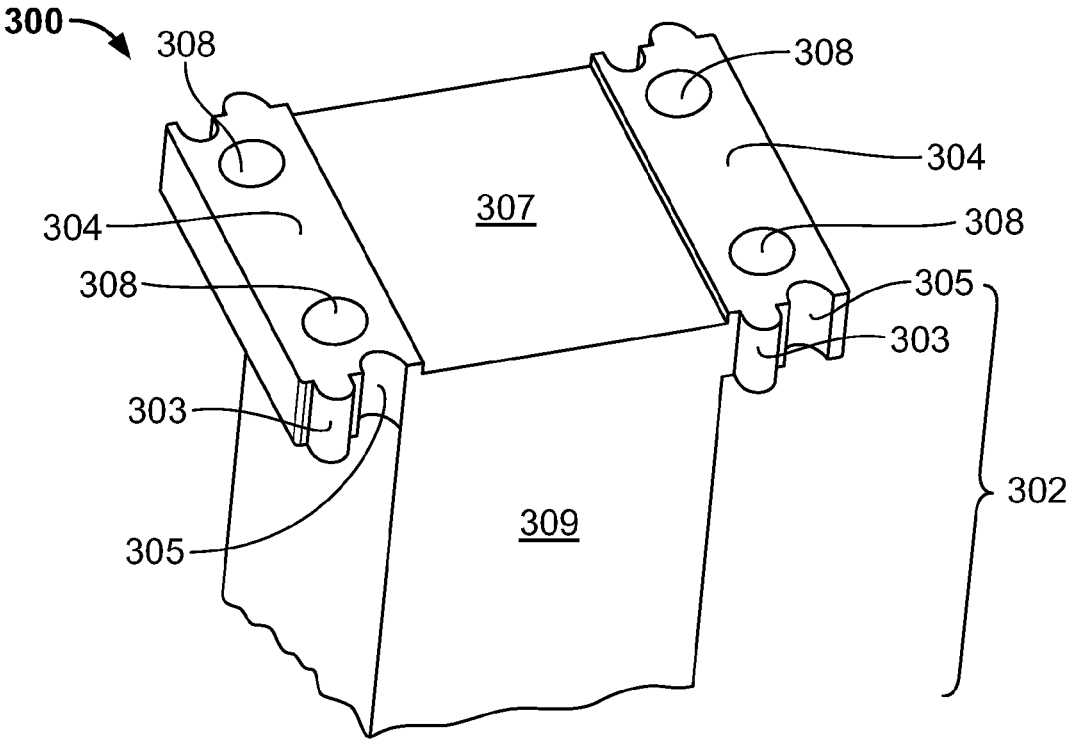
FIG. 4B shows the mounting structure of FIG. 4A.

FIG. 4A shows a perspective view of the printhead module 306 mounted in the mounting structure 302. FIG. 4B shows the mounting structure 302 with the printhead module 306 removed. In this implementation, the mounting structure 302 includes the winged portions 304 attached to a central portion 309, the entire length of which is not shown. A receiving surface 307 for the printhead module 306 is provided on an end of the central portion 309 between the winged portions 304. Apertures 308 are included in the winged portions 304 to attach the mounting structure 302 to a frame of a fluid ejection system. Such apertures 308 are optional, and other techniques can be used to attached the mounting structure to a fluid ejection system, e.g., adhesive.

The mounting structure can have other configurations, as long as the edges of the mounting structure (referred to herein as the "featured edges") adjacent the exposed edges 310, 312 of the printhead module 306 include features that extend beyond the exposed edges 310, 312, so as to provide protection from damage. That is, the mounting structure may not necessarily be configured to include winged portions 304 extending from a central portion 309, or may have a differently shaped cross-section than shown. However, whatever the configuration of the mounting structure 302, the printhead module 306 is positioned within the mounting structure such that the featured edges of the mounting structure are provided on either side of the exposed edges of the printhead module, and the featured edges include features as described above.

Figure 4C:
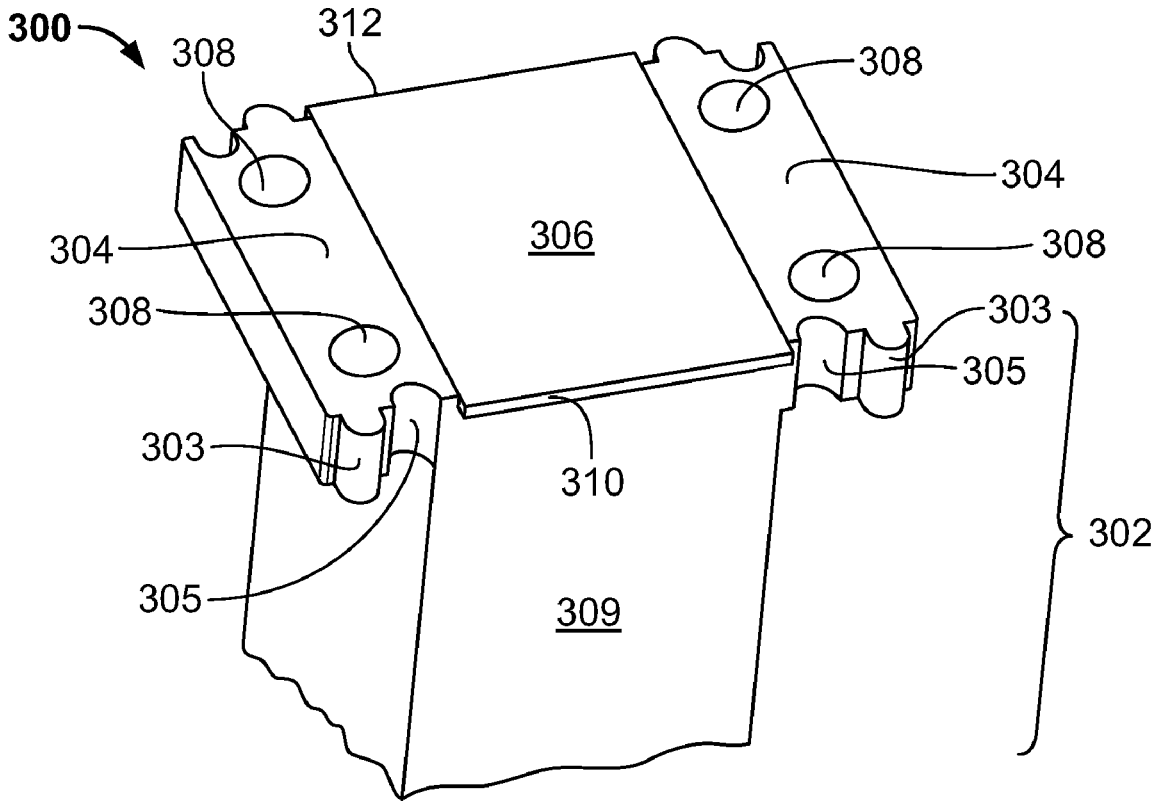
FIG. 4C shows an alternative configuration of mounting structure.

Referring again to FIGS. 4A and 4B, in the implementation shown, the nubs 303 and dimples 305 extend the entire thickness of the winged portions 304. However, in other implementations, the nubs 303 and dimples 305 extend only partially the thickness of the winged portions 304. In the implementation shown, there is one nub and one dimple on each edge of the winged portion 304 and they are arranged symmetrically about a central longitudinal axis of the receiving surface 307. In some implementations, the nubs and dimples can be arranged asymmetrically about the central longitudinal axis as shown in FIG. 4C, i.e., as a mirror image about the central longitudinal axis. An advantage of this configuration, is that the mounting structure has a "right" and "wrong" way of being mounted onto the frame of a fluid ejection system, in order that the nubs of the mounting structure mate with the dimples of a neighboring mounting structure. That is, the mounting structure cannot be inadvertently mounted backwards (i.e., rotated by 180°) onto the frame, which can be important in implementations where the printhead module has a "right" and "wrong" orientation.

In some implementations, additional nubs and dimples can be included. It should also be understood that in other implementations, the features extending beyond the exposed edges of the printhead module can have a configuration other than a nub, for example, can have squared corners, or otherwise.

The nubs 303 and dimples 305 included in the winged portions 304 of the mounting structure 302 are configured so as not to interfere with the relative positioning of neighboring printhead modules 306. That is, the nubs 303 and dimples 305 are positioned and dimensioned to allow for a nub 303 to nest within a corresponding dimple of an adjacent mounting structure, without dictating or interfering with the relative position of the printhead modules mounted within the two mounting structures.

Figure 5:
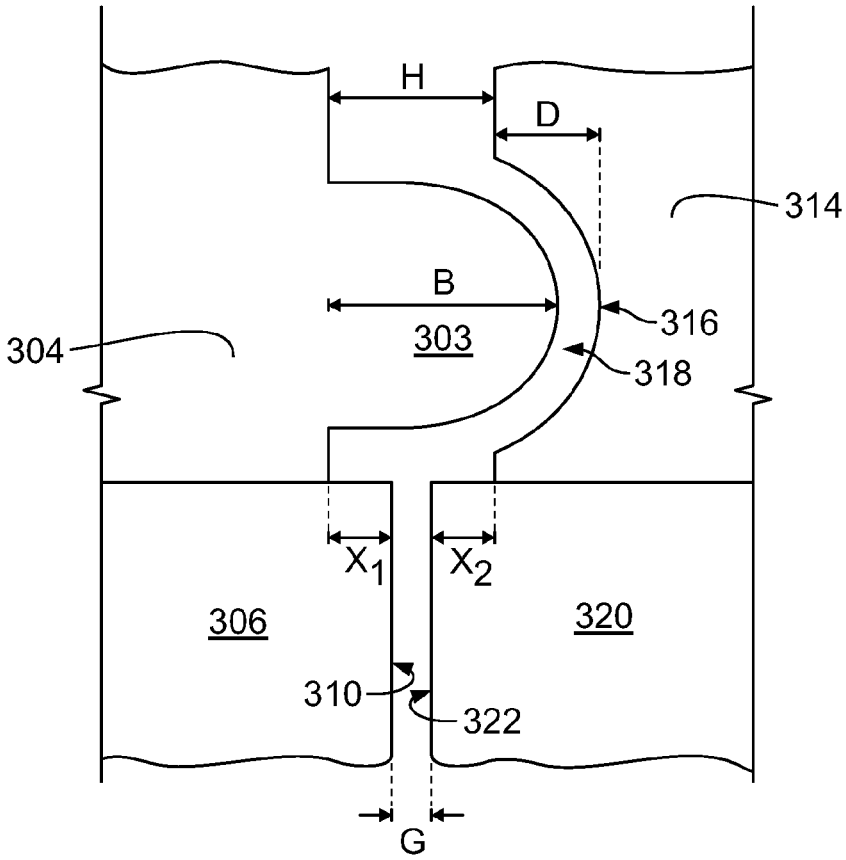
FIG. 5 shows an enlarged partial view of two adjacent printhead modules mounted in adjacent mounting structures.

FIG. 5 shows an enlarged view of a portion of a first mounting structure having a winged portion 304 positioned adjacent to a second mounting structure having a winged portion 314. For illustrative purposes, the two mounting structures are affixed into a frame of a fluid ejection system and the relative positioning of the printhead modules 306 and 320 mounted therein has been determined so as to align the nozzles of the printhead modules 306 and 320 relative to each other. The nub 303 has a depth "B" and is nested within a dimple 316 of depth "D" formed in the second mounting structure.

The outer surface of the nub 303 does not need to contact the inner surface of the corresponding dimple 316 when the first and second mounting structures are attached to the frame of the fluid ejection system. As is shown in FIG. 5, a gap 318 (which is exaggerated for illustrative purposes) can exist between the surfaces of the nub 303 and dimple 316. If the surfaces of the nub 303 and the dimple 316 do come into contact, this contact can dictate the final position of the first and second mounting structures, and therefore the relative position of the printhead modules 306 and 320 mounted therein. Preferably, the relative position of the printhead modules 306 and 320 is determined by alignment of the nozzles included in each printhead module, rather than the nubs and dimples of the mounting structures. Accordingly, the nubs and dimples can be configured and dimensioned to satisfy the relationship below, so as to prevent their interfering with the positioning of the printhead modules:

$$X_1+G+X_2+D>B$$

Where:

$X_1$=the distance by which the exposed edge 310 of the printhead module 306 extends past the edge of the winged portion 304;

G=the gap between the printhead modules 306 and 320;

$X_2$=the distance by which the exposed edge 322 of the printhead module 320 extends past the edge of the winged portion 314;

D=the depth of the dimple 316; and

B=the depth of the nub 303.

Additionally, $X_1+X_2<B$. The gap "G" between the printhead modules 306 and 320 can be determined by nozzle alignment between the two printhead modules 306, 320, and therefore can vary from instance to instance. However, a range that the gap "G" may fall within can be estimated and the minimum value in the range can be used in the above relationship to determine a value for the depth B of the nub or the depth D of the dimple.

Figure 6:
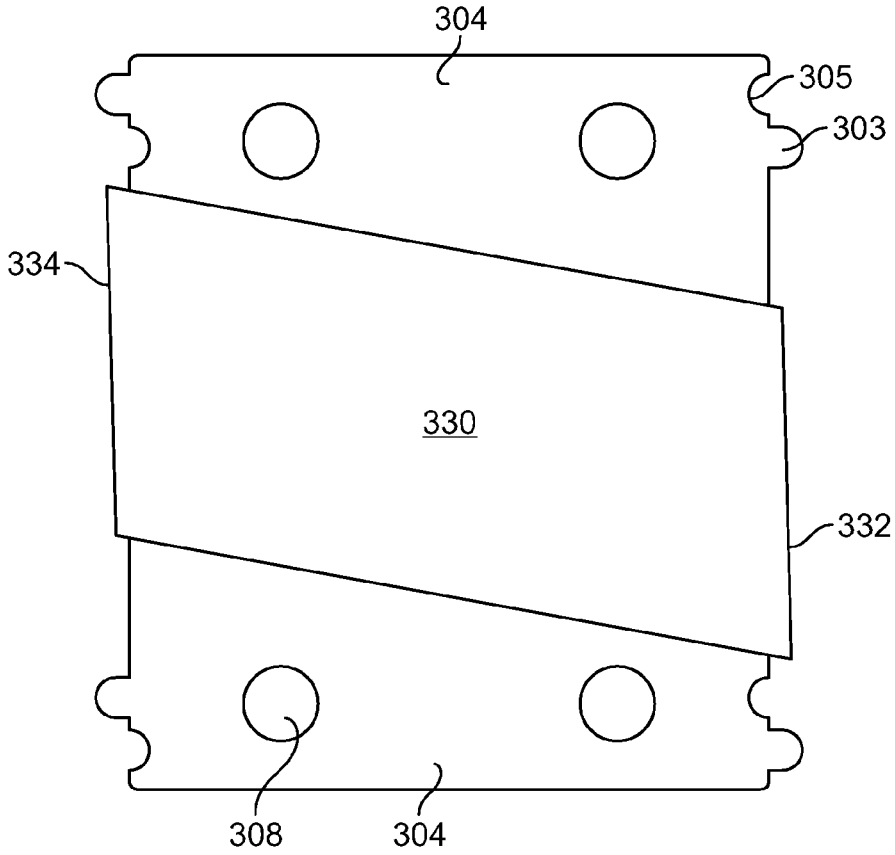
FIG. 6 shows a plan view of an alternative printhead module mounted in a mounting structure.

In the implementation shown in FIGS. 3B, 4A and 5, the printhead module 306 is configured having a rectangular shape. In other implementations, the printhead module can be configured with a different shape. In FIG. 6, an example is shown where the printhead module 330 is a non-rectangular parallelogram mounted within a mounting structure having a generally rectangular cross-section (other than the nubs and dimples included on the edges of the winged portions 304). In other implementations, the mounting structure can have a cross-section shaped other than as a rectangle.

Referring to FIG. 6, the exposed edges 332 and 334 of the printhead module 330 are angled relative to the featured edges of the winged portions 304 of the mounting structure. However, the nubs 303 still extend past the outermost corners of the edges 332 and 334, and thereby provide protection for these vulnerable edges, e.g., during the assembly process. In some implementations, a printhead module 330 having a non-rectangular parallelogram configuration as shown has an array of nozzles formed therein that are aligned parallel to the edges 332 and 334, and the printhead module 330 moves in the y direction relative to a substrate being printed on, i.e., moves in a direction parallel to the featured edges of the winged portions. Other implementations are possible, and this is but one example.

Figure 7A:
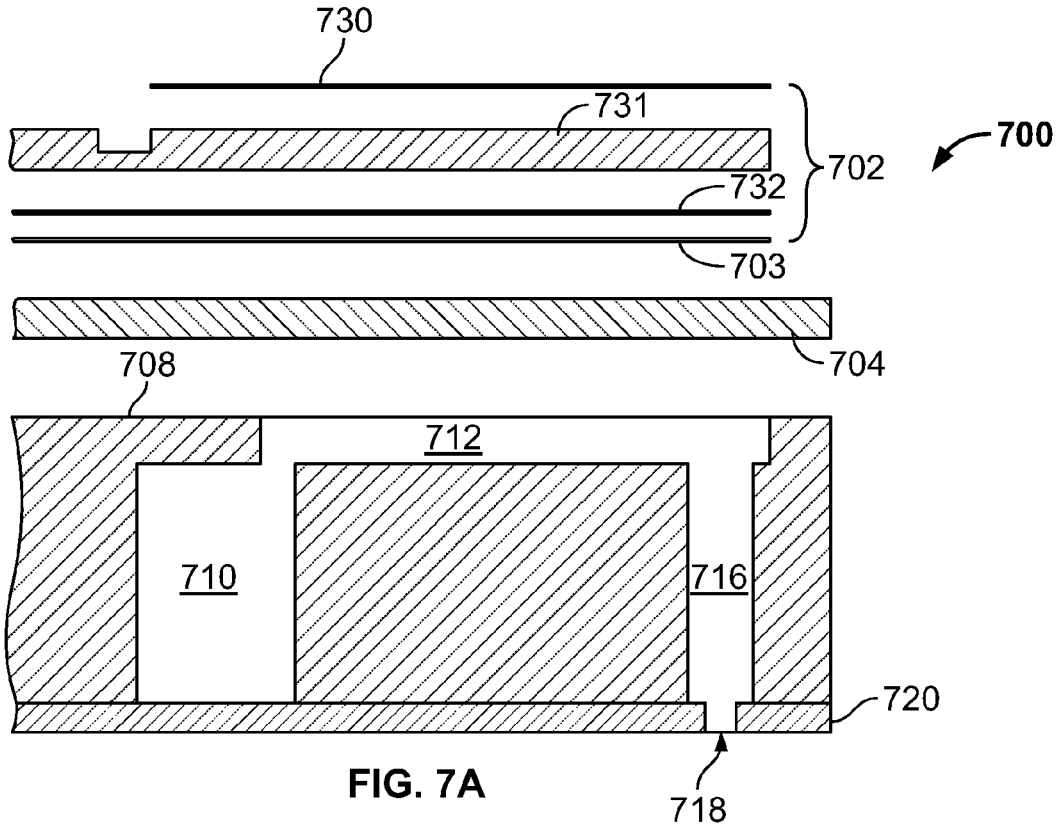
FIGS. 7A and 7B show a cross-sectional view of an example printhead module.
Figure 7B:
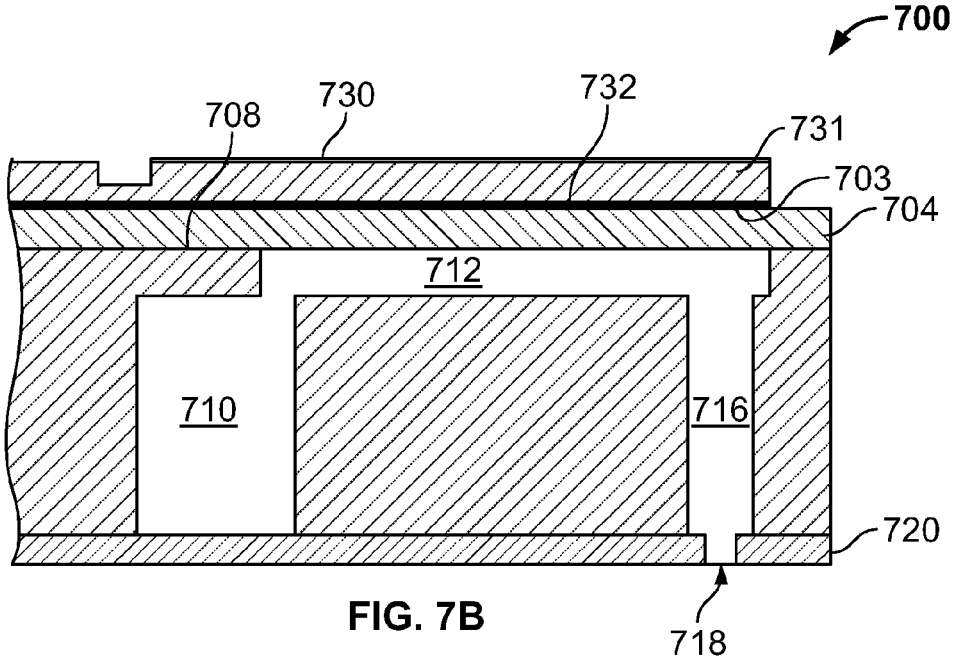

Referring to FIGS. 7A and 7B, for illustrative purposes, an example printhead module 700 is shown. A cross-sectional view of a portion of the printhead module 700 is shown and FIG. 7A shows the upper section in an exploded view. The printhead module 700 is but one example of a printhead module that can be mounted within a mounting structure as described above and is not a limiting example; other configurations can be used.

In the example shown, the printhead module 700 includes a substrate 708 in which a plurality of fluid flow paths are formed (only one flow path is shown). The printhead module 700 also includes a plurality of actuators to cause fluid (e.g., ink) to be selectively ejected from the flow paths. Thus, each flow path with its associated actuator provides an individually controllable MEMS fluid ejector.

In this implementation of a printhead module, an inlet fluidically connects a fluid supply (not shown) to a substrate 708. The inlet is fluidically connected to an inlet passage 110 through a channel (not shown). The inlet passage 710 is fluidically connected to a pumping chamber 712. The pumping chamber 712 is fluidly connected to a descender 716 terminating in a nozzle 718. The nozzle 718 can be defined by a nozzle layer 720 attached to the substrate 708.

The membrane 704 is formed on top of the substrate 708 in close proximity to the pumping chamber 712, e.g. a lower surface of the membrane 104 can define an upper boundary of the pumping chamber 712. The actuator 702 is disposed on top of the membrane 704, and an adhesive 703 is between the actuator 702 and the membrane 704. In the example shown, the actuator 702 is a piezoelectric actuator and includes a piezoelectric layer 731 positioned between a drive electrode 730 and a ground electrode 732. A voltage differential is applied across the drive and ground electrodes 730, 732 to activate the piezoelectric layer 731, causing a deflection of the piezoelectric layer 731 and the member 704. In other implementations, a different configuration of actuator can be used, for example, a thermal actuator.

It should be understood that in other implementations, the membrane 704 can be excluded, and the piezoelectric layer 731 itself can form a boundary of the pumping chamber 712. In implementations where the printing fluid can corrode the piezoelectric material, the surface forming the boundary of the pumping chamber can be protected by a protective layer, for example, a polyimide layer such as Upilex® or Kapton®.

In operation, fluid flows through the inlet into the substrate 708 and through the inlet passage 710. Fluid flows up the inlet passage 710 and into the pumping chamber 712. When the actuator 702 above the pumping chamber 712 is actuated, the actuator 702 deflects the membrane 704 into the pumping chamber 712. The resulting change in volume of the pumping chamber 712 forces fluid out of the pumping chamber 712 and into the descender 716. Fluid then passes through the nozzle 718, provided that the actuator 702 has applied sufficient pressure to force a droplet 719 of fluid through the nozzle 718. The droplet 719 of fluid is ejected and can then be deposited on a substrate.

The use of terminology such as "front" and "back" and "top" and "bottom" throughout the specification and claims is for illustrative purposes only, to distinguish between various components of the printhead module and other elements described herein. The use of "front" and "back" and "top" and "bottom" does not imply a particular orientation of the printhead module. Similarly, the use of horizontal and vertical to describe elements throughout the specification is in relation to the implementation described. In other implementations, the same or similar elements can be orientated other than horizontally or vertically as the case may be.

A number of embodiments of the invention have been described. Nevertheless, it will be understood that various modifications may be made without departing from the spirit and scope of the invention. Accordingly, other embodiments are within the scope of the following claims.

What is claimed is:

1. A printhead assembly comprising:

a printhead module mounted on a receiving surface of a mounting structure, the printhead module including a first edge and a second edge opposite the first edge where the first and second edges extend beyond edges of the receiving surface by a first distance in a first direction and the first and second edges are positioned between featured edges of the mounting structure in a second direction that is substantially perpendicular to the first direction; and the mounting structure comprising:

the receiving surface for mounting the printhead module;

the featured edges positioned on either side of the receiving surface in the second direction, where each featured edge includes:

a first feature protruding from the featured edge by a second distance in the first direction where the second distance is greater than the first distance such that the first features extend beyond the first and second edges of the printhead module; and a second feature recessed from the featured edge and configured to receive a first feature of a neighboring mounting structure;

wherein the first direction and the second direction are parallel to a face of the printhead module that includes an array of nozzles.

2. The printhead assembly of claim 1, wherein:

each first feature is configured as a nub; and each second feature is configured as a dimple.

3. The printhead assembly of claim 2, wherein:

each nub protrudes from a featured edge of the mounting structure along an axis that is substantially perpendicular to the featured edge from which the nub protrudes; and each dimple has a depth extending along an axis that is substantially perpendicular to a featured edge of the mounting structure from which the dimple is recessed.

4. The printhead assembly of claim 1, wherein the first features and the second features are arranged symmetrically about a central longitudinal axis of the receiving surface.

5. The printhead assembly of claim 1, wherein the first features and the second features are arranged asymmetrically about a central longitudinal axis of the receiving surface.

6. The printhead assembly of claim 1, wherein:

the printhead module has a substantially rectangular shape.

7. The printhead assembly of claim 1, wherein:

the printhead module has a non-rectangular parallelogram shape and the first and second edges extend beyond the edges of the receiving surface at an angle, where the first distance is the greatest distance by which the first and second edges extend beyond the edges of the receiving surface.

8. A printhead assembly comprising:

a printhead module mounted on a receiving surface of a mounting structure, the printhead module including a first edge and a second edge opposite the first edge where the first and second edges extend beyond edges of the receiving surface by a first distance in a first direction and the first and second edges are positioned between featured edges of the mounting structure in a second direction that is substantially perpendicular to the first direction; and the mounting structure comprising:

the receiving surface for mounting the printhead module;

the featured edges positioned on either side of the receiving surface in the second direction, where each featured edge includes:

a first feature protruding from the featured edge by a second distance in the first direction where the second distance is greater than the first distance such that the first features extend beyond the first and second edges of the printhead module; and a second feature recessed from the featured edge and configured to receive a first feature of a neighboring mounting structure;

wherein:

the dimensions of the first features and the second features are such that first features of the mounting structure are received into second features of a second mounting structure when the two mounting structures are positioned adjacent one another without interfering with the position of the printhead module mounted in the mounting structure relative to a second printhead module mounted in the second mounting structure.

9. The printhead assembly of claim 1, wherein the mounting structure comprises:

a central portion including the receiving surface on a face of the central portion; and winged portions flanking two opposing sides of the central portion and extending beyond a width of the central portion, where the featured edges are edges on the winged portions.

10. The printhead assembly of claim 1, wherein the winged portions are configured to attach the mounting structure to a fluid ejection system.

11. The printhead assembly of claim 8, wherein:

the depth of a first feature of the mounting structure is less than a sum of the depth of a second feature of the second mounting structure positioned to receive said first feature, a gap between the printhead module and the second printhead module, the first distance by which the printhead module extends beyond the edge of the mounting structure, and a distance by which the second printhead module extends beyond the edge of the second mounting structure.

* * * * *